US007962050B2

(12) United States Patent
Shustef et al.

(10) Patent No.: US 7,962,050 B2
(45) Date of Patent: Jun. 14, 2011

(54) SYSTEM AND METHOD FOR CONTROLLING ORDERING OF PRINTING SUPPLIES BASED ON A SERVICE CONTRACT

(75) Inventors: Yevgeniy Shustef, Macedon, NY (US); Steven C. Carey, Tigard, OR (US); Alan J. Aufderheide, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 544 days.

(21) Appl. No.: 12/101,393

(22) Filed: Apr. 11, 2008

(65) Prior Publication Data

US 2009/0257759 A1 Oct. 15, 2009

(51) Int. Cl.
*G03G 15/00* (2006.01)
*G03G 21/00* (2006.01)

(52) U.S. Cl. ..... 399/8; 399/79

(58) Field of Classification Search ..... 399/8, 79, 399/411

See application file for complete search history.

(56) References Cited

U.S. PATENT DOCUMENTS 5,305,199 A * 4/1994 LoBiondo et al. ..... 705/28
5,335,048 A * 8/1994 Takano et al. ..... 399/8
6,016,049 A 1/2000 Baughman et al.
6,275,664 B1 * 8/2001 Wolf et al. ..... 399/8
6,798,995 B2 * 9/2004 Nagata ..... 399/8
6,940,613 B1 9/2005 Beard et al.
7,433,607 B2 * 10/2008 Thomas ..... 399/8
7,650,085 B2 * 1/2010 Kehoe et al. ..... 399/8
7,729,622 B2 * 6/2010 Yamanaka ..... 399/8

* cited by examiner

*Primary Examiner* — David M Gray
*Assistant Examiner* — Fred Braun
(74) *Attorney, Agent, or Firm* — Carter, DeLuca, Farrell & Schmidt, LLP

(57) ABSTRACT

A system and method for managing customer orders associated with at least one printer device for consumable supplies under a contract. The method includes receiving printer usage data from at least one printer indicative of consumption of at least one consumable supply and calculating for each printer device based on the received print usage data associated with the printer device an allowed amount of at least one consumable supply that can be ordered for the printer device by a customer based on a contract. The method further includes receiving a customer order request for ordering an amount of a consumable supply for a printer device under the contract; determining whether the requested amount exceeds the allowed amount calculated for the consumable supply for the printer device, and limiting the amount of the requested consumable supply which can be ordered when the determination is positive.

20 Claims, 3 Drawing Sheets

SYSTEM AND METHOD FOR CONTROLLING ORDERING OF PRINTING SUPPLIES BASED ON A SERVICE CONTRACT

BACKGROUND

1. Field of the Disclosure

This disclosure relates to a system and method for providing customer support for ordering consumable supplies, such as printing supplies, through a service contract. In particular, this disclosure relates to an internet enabled system and method for controlling the supplies ordered by the customer.

2. Description of the Related Art

In the printing industry it is common for printer manufacturers to sell or rent a printer together with a service contract. The service contract may include terms which specify that the customer is entitled to receive consumable printing supplies for their printing needs associated with the printer. Based on the service contract, the customer may place orders for the consumable supplies as they are needed.

SUMMARY

In an embodiment of the present disclosure, a supply control system for managing customer orders associated with at least one printer device for consumable supplies under a contract is provided. The supply control system includes a services manager having a processor; and a supply control module including a series of programmable instructions executable by the processor for receiving printer usage data from at least one printer device indicative of consumption of at least one consumable supply. The supply control module calculates for each printer device of the at least one printer device based on the received print usage data associated with the printer device an allowed amount of at least one consumable supply that can be ordered for the printer device by a customer based on a contract. The supply control module further receives a customer order request for ordering an amount of a consumable supply for a printer device of the at least one printer device under the contract. The supply control module limits the amount of the requested consumable supply which can be ordered when the requested amount exceeds the allowed amount calculated for the consumable supply for the printer device.

In another embodiment of the disclosure a method is provided for managing customer orders associated with at least one printer device for consumable supplies under a contract. The method includes receiving printer usage data from at least one printer indicative of consumption of at least one consumable supply. The method further includes calculating for each printer device based on the received print usage data associated with the printer device an allowed amount of at least one consumable supply that can be ordered for the printer device by a customer based on a contract. In addition, the method includes receiving a customer order request for ordering an amount of a consumable supply for a printer device under the contract, and determining whether the requested amount exceeds the allowed amount calculated for the consumable supply for the printer device. When the determination is positive, the method includes limiting the amount of the requested consumable supply which can be ordered.

In still another embodiment of the disclosure a computer-readable medium storing a series of programmable instructions configured for execution by at least one processor is provided for performing a method of managing customer orders for consumable supplies under a contract. The supplies are consumable by at least one apparatus. The method includes receiving apparatus usage data from at least one apparatus indicative of consumption of at least one consumable supply. The method further includes calculating for each apparatus of the at least one apparatus based on the received apparatus usage data associated with the apparatus an allowed amount of at least one consumable supply that can be ordered for the apparatus by a customer based on a contract. In addition, the method includes receiving a customer order request for ordering a consumable supply for an apparatus of the at least one apparatus under the contract and determining whether the requested amount exceeds the allowed amount calculated for the consumable supply for the apparatus. When the determination is positive, the method includes limiting the amount of the requested consumable supply which can be ordered.

BRIEF DESCRIPTION OF THE DRAWINGS

Various embodiments of the disclosure will be described herein below with reference to the figures wherein.

DETAILED DESCRIPTION OF THE PREFERRED EMBODIMENTS

Figure 1:
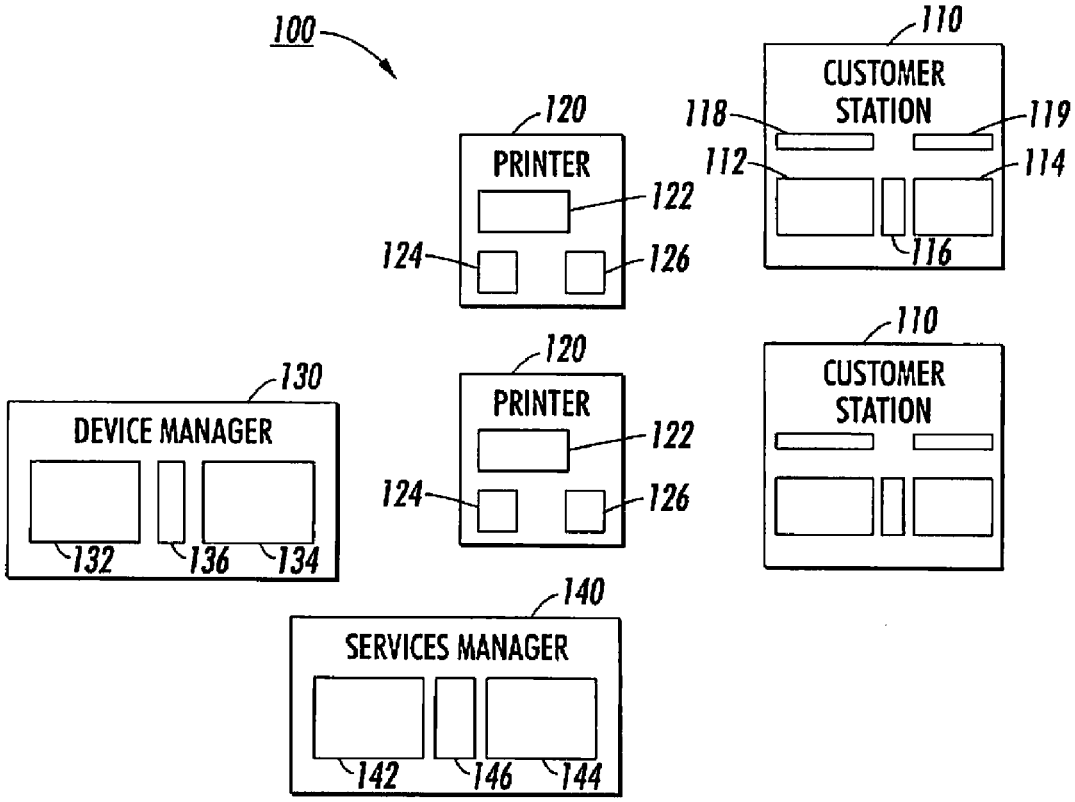
FIG. 1 is a block diagram of a supply control system for providing customer service for the ordering of printing supplies in accordance with the present disclosure.

Referring now to the drawing figures, in which like references numerals identify identical or corresponding elements, a system and method for controlling to a threshold level supply orders based on an appliance service contract in accordance with the present disclosure will now be described in detail. With initial reference to FIG. 1, an exemplary system for controlling service contract based supply orders in accordance with the present disclosure is illustrated and is designated generally as supply control system 100. Supply control system 100 includes a customer station 110, a printer device 120, a device manager 130 and a services manager 140, each of which includes a respective processing device (including or accessing at least one storage device), a respective software module executable on the associated processing device and a respective communication device. The respective communication devices facilitate communication between the various processors, as described further below.

The printer device 120 was purchased or rented from a product manufacturer or product dealer together with the purchase of a sales contract which includes terms for providing consumable supplies associated with use of the printer device 120. The customer station 110 may be operated by an authorized operator or administrator associated with the customer. The administrator enters an order request for printer supplies based on the service contract via the customer station 110. As described further below, the services manager 140 receives order requests from the customer station 110.

The services manager 140 further monitors supply usage by the printing device 120. As the printer is operated it records data about the printer usage and transmits the data to the device manager 130. The services manager 140 receives the printer usage data from the device manager 130, stores the printer usage data for the printer and calculates the amount of supplies that the customer is entitled to order under the services contract based on the stored usage data and the terms of the contract. The services manager 140 executes an algorithm to determine the amount of supplies which the customer is entitled to order (Allowed_Supply). The algorithm uses the usage data as well as the ink or toner cartridge yield, the type of printer device 120 used, previous ordering history and industry information to calculate Allowed_Supply. When an order request is received from the customer station 110, the services manager 140 determines if the customer is entitled to the supplies ordered and limits the amount of supplies which the customer is allowed to order based on Allowed_Supply. The algorithm may be adjusted to accommodate special customer needs upon customer request.

The supply control system 100 is now described in greater detail. The customer station 110 may be a computing device such as a computer workstation, a personal computer, a handheld device, e.g., a personal digital assistant, etc. The customer station 110 is provided with a processor 112 and customer portal software module 114 executable on the processor 112 or accessible to the processor 112. The customer station 110 further includes at least one communication device 116 for exchanging information between the processor 112 and another processor, such as a processor of the services manager 140. The customer portal module 114 includes a series of programmable instructions capable of being executed or accessed by processor 112. The series of programmable instructions can be stored on a computer-readable medium, such as RAM, a hard drive, CD, smart card, 3.5" diskette, etc., or transmitted via propagated signals for being executed by the processor 112 for performing the functions disclosed herein and to achieve a technical effect in accordance with the disclosure.

The customer portal module 114 may be stored by customer station 110 in non-volatile memory, such as a hard drive, or volatile memory, such as RAM. The customer portal module 114 may be installed at the time of manufacture, or by the user, such as by installing the software from a CD or by downloading or accessing the software from a website provided by the manufacturer of the printer device 120.

The customer station 110 includes a display device 119 (such as a computer monitor) and an input device 118 (such as keyboard, mouse, etc.). The customer portal module 114 generates a graphical user interface (GUI) displayable on the display device 119 for interacting with the administrator or user. The GUI provides a graphical interface, such as a form displayed on the display device 119, which the user uses to place an order request. The user can submit the order using the GUI. Upon submission of the order request, the order request information, Order_Request, is transmitted by the communication device 116 to the services manager 140.

The customer station 110 may be part of one or more networks, such as a LAN, WAN, intranet or the Intranet which facilitates communication between the customer station 110 and the services manager 140. The at least one communication device 116 provides communication between the processor 112 and the network. The at least one communication device 116 includes, for example, a modem, router and/or Ethernet port. For example, when a user of the customer station 110 accesses the manufacturer's website via the Internet, the processor 112 accesses the customer portal module 114 which provides the user with the GUI that the user uses to make and submit an order. Upon submitting an order, the Order_Request is transmitted to the services manager 140.

The printer device 120 includes a processor 122, a meter software module 124, is and at least one communication device 126. The term "printer device" as used herein encompasses any apparatus or system, such as a digital copier, xerographic printing system, ink jet printing system, reprographic printing system, bookmaking machine, facsimile machine, multifunction machine, textile marking machine, etc., which performs a marking output function for any purpose and requires consumable supplies, such as toner, ink or lubricants for the operation thereof. The disclosure is not limited to a printer device. The device may be any apparatus whose operation requires the use of at least one type of supply which must be replenished, such as based on the terms of a service contract.

The consumable supplies include, for example, black or colored toner or lubricants, Toner includes a powder and/ or liquid for marking a substrate, including, for example, ink, colorant, pigment, dye or a combination of one or more of ink, colorant, pigment or dye. The consumable supply is a material which is consumed by the apparatus. The consumable supply may be consumed through ordinary use of the apparatus. The rate of consumption can be measured and is predictable based on the degree of use of the apparatus. For example, where the apparatus is a printing device 120, the rate of consumption of toner is predictable and measurable based on the number of impressions which are printed.

The meter module 124 includes a series of programmable instructions capable of being executed by processor 122. The series of programmable instructions can be stored on a computer-readable medium, such as RAM, a hard drive, CD, smart card, 3.5" diskette, etc., or transmitted via propagated signals for being executed by the processor 122 for performing the functions disclosed herein and to achieve a technical effect in accordance with the disclosure.

As the printer device 120 is operated to execute print jobs the information related to the jobs performed by the printer are recorded by the meter module 124. The data is stored by the processor 122 on a storage device (not shown) included with or accessed by the processor 122. For example, the meter module 124 records the number of impressions or pages that are printed. The meter module 124 may keep a running tally of the total number of pages printed and/or the number of pages printed since a most recent report was generated. The tally for large pages or impressions may be weighted to account for their size. For example, a large page may be tallied as two pages. It is envisioned that the meter module 124 may record additional information, such as the date that a new toner cartridge is installed, the type of toner cartridge installed, maintenance performed on the printer, etc. This information indicates the consumption of the toner by the printer device 120.

The meter module 124 transmits Printer_Usage data, including information stored by the meter module 124 that is related to the consumption of supplies by the printer device 120, via the communication device 126 to the device manager 130. The Printer_Usage data which is tracked and stored by the meter module 124 may be measured in impressions, which may be broken down, for example, into black vs. color impressions. The Printer_Usage data may also be measured by toner cartridge consumption based on tracking when toner cartridges are replaced. The transmission of the Printer_Usage data may be performed at intervals, such as at regular time intervals (e.g., once per week), at paper usage quota intervals (e.g., once per 1,000 pages printed), or at toner cartridge quota replacement intervals. On the other hand, the transmission of Printer_Usage data may be performed based on the occurrence of an event, such as a user request (where the request is user entered via a user entry device (not shown) at the printer device 120 or the device manager 130), a processor generated request (by the processor 122 or a processor of the device manager 130), a toner cartridge replacement, a maintenance tune-up, submission of an order request, etc.

The printer device 120 may be part of one or more networks, such as a LAN, WAN, intranet or the Internet which facilitates communication between the printer device 120 and the device manager 130. The at least one communication device 126 provides communication between the processor 122 and the network. The at least one communication device 126 includes, for example, a modem, router and/or Ethernet port. The printer device 120 receives printer job requests from one or more computers (which may or may not include the customer station 110) which are coupled to or networked (e.g., via a LAN, WAN or intranet) to the printer device 120.

The device manager 130 is a computing device including a processor 132, a device manager software module 132 and at least one communication device 136. The device manager module 134 receives Printer_Usage data from at least one printer devices 120. The Printer_Usage data includes an identifier, Printer ID, identifying the printer that transmitted the data, and usage data such as the total number of pages printed or the number of pages printed since the last report by transmission of Printer_Usage data. The device manager module 134 forwards the Printer_Usage data to the Services Manager 140. The device manager module includes a series of programmable instructions capable of being executed by processor 132. The series of programmable instructions can be stored on a computer-readable medium, such as RAM, a hard drive, CD, smart card, 3.5" diskette, etc., or transmitted via propagated signals for being executed by the processor 132 for performing the functions disclosed herein and to achieve a technical effect in accordance with the disclosure.

The device manager 130 communicates with the printer device 120 and the services manager 140 via its communication device(s) 136. The device manager 130 may be part of one or more networks, such as a LAN, WAN, intranet or the Internet which facilitates communication between the device manager 130 and the services manager 140 and between the device manager 130 and the services manager 140. Different networks may be used by the device manager 130 for communicating with the printer device(s) 120 and the services manager 140. The at least one communication device 136 provides communication between the processor 132 and the at least one network. The at least one communication device 136 includes, for example, a modem, router and/or Ethernet port.

The services manager 140 is a computing device which receives Order_Requests generated by at least one customer station 110 and Printer_Usage data from the device manager 130. The services manager includes a processor 142, a supply control software module 144 and at least one communication device 146. The supply control module 144 performs calculations on the Printer_Usage data received for determining an Allowed_Supply quantity for the printer associated with the Printer_Usage data. When the services manager 140 receives an Order_Request from a customer station 110, the supply control module 144 processes the Order_Request, which includes limiting the amount of supplies which can be ordered by the Order_Request based on the Allowed_Supply associated with the printer for which the Order_Request is requesting supplies.

The supply control module 144 includes a series of programmable instructions capable of being executed by processor 142. The series of programmable instructions can be stored on a computer-readable medium, such as RAM, a hard drive, CD, smart card, 3.5" diskette, etc., or transmitted via propagated signals for being executed by the processor 142 for performing the functions disclosed herein and to achieve a technical effect in accordance with the disclosure.

Figure 2:
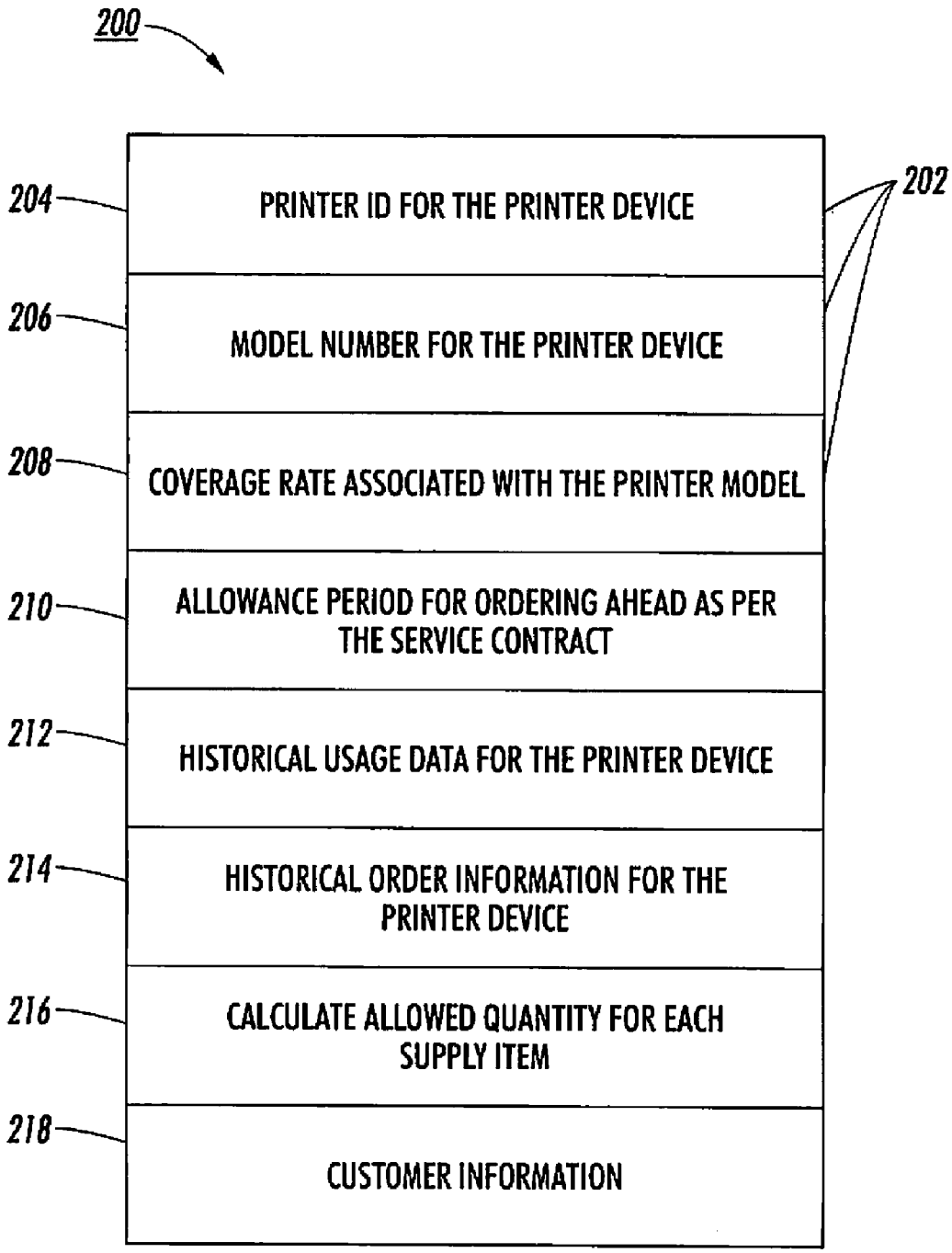
FIG. 2 is a schematic diagram of a data record stored by the supply control system shown in FIG. 1.

The processor 142 includes or accesses at least one data storage device which stores data associated with each printer device 120 that is transmitting Printer_Usage data to the device manager 130. A database 200 storing exemplary data records 202 stored by the storage device are shown in FIG. 2, with each data record 202 storing data associated with a particular printer device 120 in a plurality of fields. The plurality of fields includes a field 204 storing a Printer ID identifying the printer device 120, a field 206 storing a model number for the printer device 120, and a field 208 storing coverage rate associated with the printer model for at least one supply item covered by the service contract. The coverage data may include separate coverage data for the various toners used, which for a color printer may include black, red, cyan and magenta. The coverage data may be based on industry information known for the particular printer device model, or may be set at different levels than industry standards, such as defined by the service contract terms or program procedures, The plurality of fields further includes a field 210 storing an allowance period, which is a service contract term describing a time interval for which the customer can order in advance a supply item, a field 212 storing historical usage data (e.g., stored in impressions (black and color impressions may be stored separately) indicating consumption of at least one supply for the printer device 120, a field 214 storing historical order information for the printer device 120, a field 216 storing Allowed_Supply, a calculated allowed quantity for each supply item, and a field 218 storing customer information, such as shipping address and billing information.

The disclosure is not limited to the exemplary configuration of data storage shown in FIG. 2. For example, the coverage data may be stored in a separate coverage data database accessible by the processor 142 which stores coverage data for various supply items for a variety of printer models.

The services manager 140 communicates with at least one customer station 110 and the services manager 130 via its communication device(s) 146. The services manager 140 may be part of one or more networks, such as a LAN, WAN, intranet or the Internet which facilitates communication between the services manager 140 and the customer station(s) 110 and between the services manager 140 and the device manager 130. Different networks may be used by the services manager 140 for communicating with the customer station(s) 110 and the device manager 130. The at least one communication device 146 provides communication between the processor 142 and the at least one network. The at least one communication device 146 includes, for example, a modem, router and/or Ethernet port.

The supply control module 144 stores Printer_Usage data as it is received from a particular printer device 120 in the field 212 of a data record 200 associated with the printer device 120. In the present example, the Printer_Usage data is stored in terms of impressions with an associated date indicating the date that the meter module 124 transmitted the data to the device manager 130. Since Printer_Usage data is stored upon receipt, the data stored may include current updated Printer_Usage data.

The supply control module 144 updates the Allowed_Supply quantity for each supply item for each printer device 120 or a particular printer device 120 such as at regular intervals and/or upon the occurrence of an event. Events include, for example, receipt of an Order_Request associated with a particular printer device 120, receipt of Printer_Usage data for a particular printer device 120, and/or an update to service contract terms for a particular printer device 120.

Figure 3:
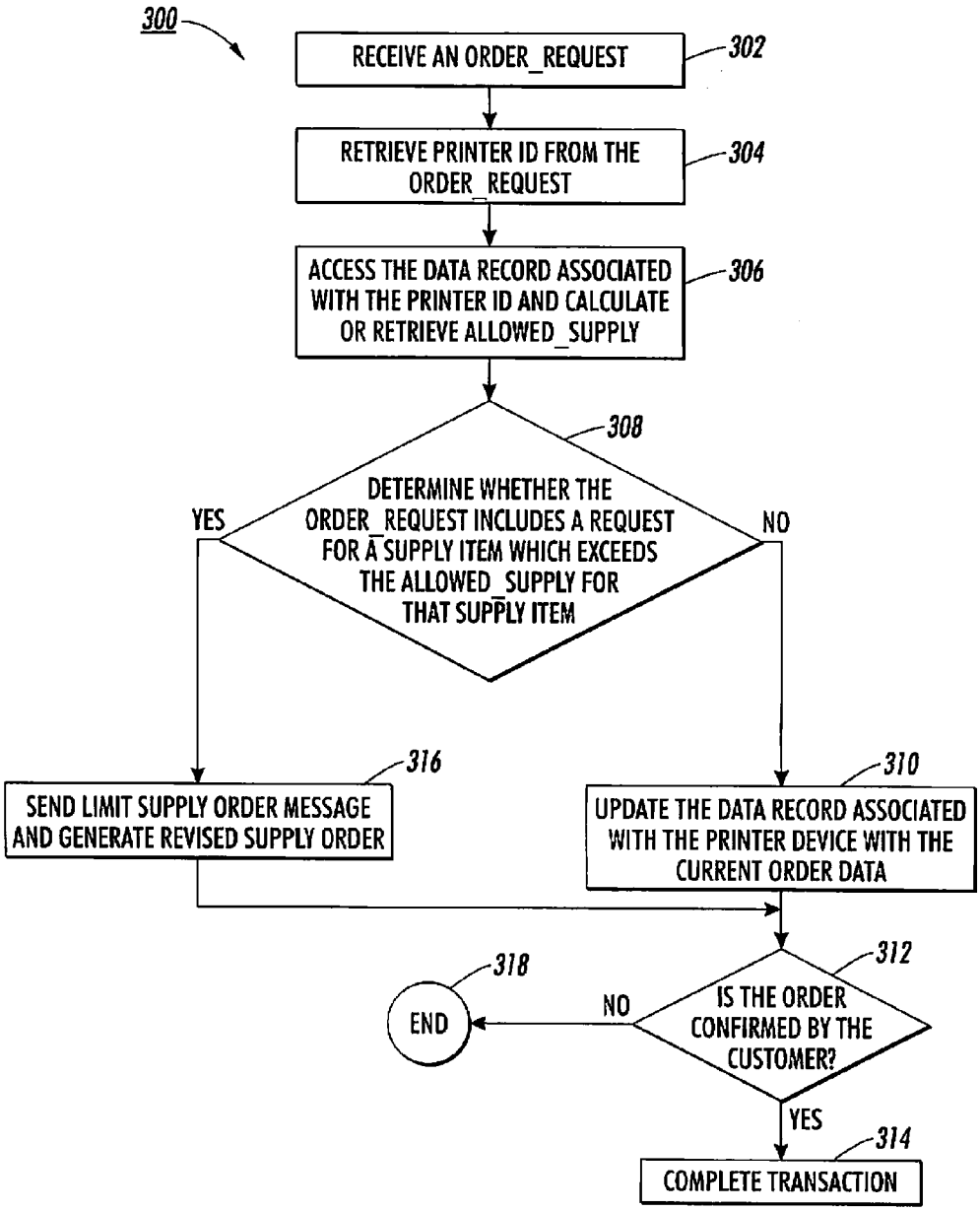
FIG. 3 is a flowchart showing operation of executed by a supply control module of the supply control system shown in FIG. 1.

FIG. 3 shows a flowchart 300 showing operation of the supply control module 144 upon receipt of an Order_Request. At step 302, the supply control module 144 receives an Order_ Request. At step 304, the supply control module 144 retrieves the Printer ID from the Order_Request. At step 306, the supply control module 144 accesses the data record 200 which is associated with the Printer ID and either calculates the Allowed_Supply quantity for the supply item requested in accordance with an algorithm described below or retrieves the Allowed_Supply quantity, depending on what condition (time interval or event) triggers updating Allowed_Supply.

At step 308, the supply control module 146 determines whether the Order_Request includes a request for a supply item which exceeds the Allowed_Supply for that supply item. If not, at step 310, the supply control module 144 proceeds to update the record 200 associated with the associated printer device 120 with the current order data, such as by updating the historical order data field 214 with the current date, the supply item ordered, and the quantity ordered. At step 312, the order is confirmed with the customer, such as by requesting that the customer confirm information, such as the Printer ID, printer model, supply item, quantity ordered, billing data and shipping address. Confirmation of the order may be performed by sending a Confirmation_Request to the customer portal module 114. The customer portal module 114 displays the information to be confirmed to the user of the customer station 110 and requests that the user enter a confirmation entry via the GUI, which is sent to the supply control module 144, completing the confirmation process.

At step 314, the order is processed for filling, e.g., the transaction is completed. Completion of the transaction includes, for example, preparing a shipping and handling label and instructions and transacting the financial portion of the transaction using the billing information.

If at step 308, the determination was that the amount of the supply item being ordered in Order_Request exceeded the Allowed_Supply, then control passes to step 316. At step 316, a limit supply order message is sent to the customer station 110 for display by the display device 119 to tell the user that the supply order must be limited to the quantity designated by Allowed_Supply. The limit supply order message is accompanied with a revised supply order. Control proceeds to step 312 for confirmation of the revised supply order, which is followed by step 314 in which the transaction is completed.

If the user prefers at step 312 not to confirm the revised supply order, then the order is not transacted and the order session is terminated at step 318. The user may contact customer service. If customer service decides that the user has a valid reason to exceed Allowed_Supply, then the formula for determining Allowed_Supply may be adjusted, as described further below. This may be performed by human decision making, or by an automated process, in which the user submits data indicative of the reason that a greater supply is needed. The person or an algorithm determines if the user submitted data meets criteria for adjusting the algorithm for determining Allowed_Supply, and if so adjusts the algorithm. Once the algorithm is adjusted, the user may submit a new Order_Request, where control returns to step 302.

An exemplary algorithm for determining Allowed Supply for a particular supply item for a particular printer device 200 is shown at Equation 1. The disclosure is not limited to the exemplary algorithm.

$$\text{Allowed_Supply}=(MAI-(PCUP-TU))/YTACL \qquad \text{EQUATION 1}$$

Where:

Maximum Allowed Inventory (MAI) is average # pages printed per month to date according to the current meter module 224 output (i.e., at the time that the Order_Request was submitted) (this is retrieved from field 214) Allowance Period;

Allowance Period is a time interval which acts as a buffer period for which the customer can order ahead as per the service contract, for example two months (this is retrieved from field 210);

Pages Covered in Usage Period (PCUP) is # pages covered by the consumables sold for the usage period.

Total Usage (TU) is # pages printed since a last Order_Request was received which is: (current meter module 224 output—meter module 224 output at time of receipt of last Order_Request) (these are both retrieved from field 212);

Yield per Supply Item Adjusted for Coverage Level (YTACL) is the # pages that can be printed with the supply item. This is adjusted based on the Coverage Rate that applies to the supply item (This is calculated using Calculated Rate);

Coverage Rate is the amount of the supply item that is used to output each page. This is determined based on industry knowledge for the printer model and supply item and may vary for different models of printer devices 200 and for different types of printing uses (This is retrieved from field 208);

For example, where the supply item is black toner, 5% of each page is covered with black ink, on average. This may increase, for example, to 10% when the printer device 200 is used to print marketing material; and Allowed_Supply is calculated and stored in field 218.

Criteria for determining that the algorithm for determining whether Allowed_Supply should be adjusted may include, for example, where there is a change in the expected type of printing jobs that are being executed by the printer device 120, or where the workflow of the printer device 120 is seasonal (e.g., tax season for an accounting firm). The adjustments may include, for example, changing the Coverage Rate and/or extending the Allowance Period. Another adjustment may be made to the consumable yield it for example, historical data or manufacturer data indicates a change from the original specification.

In summary, the supply control system 100 provides for tracking printer device usage including supplies consumption, printer device volumes and area coverage. The printer device usage tracking is transparent to the customer. The services manager 140 serves as a repository for the tracked information and industry information, such as known toner yield. The services manager 140 monitors the usage and ordering behavior associated with a plurality of printer devices 120 and then applies the monitored behaviors and industrial information using a formula for controlling customer ordering of supplies for the printer devices 120. This model applies to any printing supply that has a known rated life measured in impressions. This model may further apply supplies for other types of devices using supplies which have a known rated life measured against a measurable usage metric.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, or a combination thereof.

The invention claimed is:

1. A services manager system associated with a consumables supplier that manages and fills customer orders associated with at least one printer device for consumable supplies under an associated service contract, the services manger system comprising:

a processor; and a supply control module including a memory with a series of programmable instructions executable by the processor for:

receiving printer usage data from at least one printer device indicative of consumption of at least one consumable supply;

calculating for each printer device of the at least one printer device based on the received print usage data associated with the printer device an allowed amount of at least one consumable supply that can be ordered for the printer device by a customer based on a service contract, wherein the service contract includes terms for providing consumable supplies by the supplier to a customer possessing the printer device;

receiving a customer order request for ordering an amount of a consumable supply for a printer device of the at least one printer device under the service contract associated with the printer device; and processing the customer order request for filling the order request;

wherein the supply control module limits the amount of the requested consumable supply which can be processed for filling when the requested amount exceeds the allowed amount calculated for the consumable supply for the printer device.

2. The services manager system according to claim 1, wherein the consumable supply is toner.

3. The services manager system according to claim 2, wherein the printer usage data for a printer device of the at least one printer device indicates a quantity of units of printing executed by the printer device, and the calculation of the allowed amount for the printer device is further based on predetermined coverage rate data describing the amount of toner used when printing a unit.

4. The services manager system according to claim 3, wherein the unit of printing is an impression.

5. The services manager system according to claim 1, wherein the calculation of the allowed amount is further based on an allowance period which is a predetermined time interval for which the consumer is allowed to order at least one consumable supply in advance.

6. The services manager system according to claim 3, wherein:

the calculation of the allowed amount is further based on an allowance period which is a predetermined time interval for which the consumer is allowed to order the at least one consumable supply in advance; and the calculation is adjustable upon request by adjusting at least one of the coverage rate data and the allowance period.

7. The services manager system according to claim 1, wherein:

the supply control module's memory further comprises programmable instructions for revising the order request and submitting the revised order request to the customer for confirmation when it is determined that the requested amount exceeds the allowed amount; and wherein the processing the customer order request for filling of the order is only performed upon at least one of:

it is determined that the requested amount does not exceed the allowed amount; and confirmation of the revised order request is received from the customer.

8. The services manager system according to claim 1, wherein the calculation of the allowed amount is further based on at least one previously received customer order request associated with the printer device.

9. A method for managing customer orders associated with at least one printer device for consumable supplies under a an associated service contract, the method comprising:

receiving by a processor printer usage data from at least one printer indicative of consumption of at least one consumable supply;

calculating by the processor for each printer device of the at least one printer device based on the received print usage data associated with the printer device an allowed amount of at least one consumable supply that can be ordered for the printer device by a customer based on a service contract, wherein the service contract includes terms for providing consumable supplies by the supplier to a customer possessing the printer device;

receiving by the processor a customer order request for ordering an amount of a consumable supply for a printer device of the at least one printer device under the contract;

determining by the processor whether the requested amount exceeds the allowed amount calculated for the consumable supply for the printer device;

limiting by the processor the amount of the requested consumable supply which can be processed for filling when the determination is positive.

processing by the processor the customer order request for filling the order request.

10. The method according to claim 9, wherein the consumable supply is toner.

11. The method according to claim 10, wherein the printer usage data for a printer device of the at least one printer device indicates a quantity of units of printing executed by the printer, and the calculating of the allowed amount for the printer device is further based on predetermined coverage rate data describing the amount of toner used when printing a unit.

12. The method according to claim 11, wherein the unit of printing is an impression.

13. The method according to claim 9, wherein the calculating of the allowed amount is further based on an allowance period which is a predetermined time interval for which the consumer is allowed to order at least one consumable supply in advance.

14. The method according to claim 9, wherein:

the calculating of the allowed amount is further based on an allowance period which is a predetermined time interval for which the consumer is allowed to order the at least one consumable supply in advance;

the method further comprising adjusting by the processor the calculation by adjusting at least one of the coverage rate data and the allowance period.

15. The method according to claim 9, wherein the calculating the allowed amount is further based on at least one previously received customer order request associated with the printer device.

16. The method according to claim 9, wherein the limiting comprises:

revising the order request; and submitting the revised order request to the customer for confirmation.

17. The method according to claim 16, wherein the processing the customer order request is only performed:

upon at least one of:

the determining outcome is that the requested amount does not exceed the allowed amount; and receiving by the processor confirmation from the customer of the revised order request.

18. A non-transitory computer-readable medium storing a series of programmable instructions configured for execution by at least one processor for performing a method of managing customer orders for consumable supplies under an associated service contract, wherein the supplies are consumable by at least one apparatus, the method comprising:

receiving apparatus usage data from at least one apparatus indicative of consumption of at least one consumable supply;

calculating for each apparatus of the at least one apparatus based on the received apparatus usage data associated with the apparatus an allowed amount of at least one consumable supply that can be ordered for the apparatus by a customer based on a service contract, wherein the service contract includes terms for providing consumable supplies by the supplier to a customer possessing the at least one apparatus;

receiving a customer order request for ordering a consumable supply for an apparatus of the at least one apparatus under the service contract associated with the at least one apparatus;

determining whether the requested amount exceeds the allowed amount calculated for the consumable supply for the apparatus;

limiting the amount of the requested consumable supply which can be processed for filling when the determination is positive; and processing the customer order request for filling the order request.

19. The computer-readable medium according to claim 18, wherein the calculating of the allowed amount is further based on an allowance period which is a predetermined time interval for which the consumer is allowed to order at least one supply in advance.

20. The computer-readable medium according to claim 18, wherein the calculating the allowed amount is further based on at least one previously received customer order request associated with the apparatus.

* * * * *